US007413494B2

(12) United States Patent
Huang

(10) Patent No.: US 7,413,494 B2
(45) Date of Patent: Aug. 19, 2008

(54) INFLATABLE BAG FOR EMITTING LIGHT

(76) Inventor: Chung-Tao Huang, 5F, No. 8, Alley 43, Lane 120, Yungchi Rd., Taipei (TW)

( * ) Notice: Subject to any disclaimer, the term of this patent is extended or adjusted under 35 U.S.C. 154(b) by 108 days.

(21) Appl. No.: 11/492,040

(22) Filed: Jul. 25, 2006

(65) Prior Publication Data

US 2007/0157497 A1 Jul. 12, 2007

(30) Foreign Application Priority Data

Jan. 10, 2006 (TW) ..... 95200514 U

(51) Int. Cl.
*A63H 3/06* (2006.01)

(52) U.S. Cl. ..... 446/220; 446/219; 362/565

(58) Field of Classification Search ..... 446/219–226, 446/338, 339; 362/565, 232
See application file for complete search history.

(56) References Cited

U.S. PATENT DOCUMENTS 5,102,131 A * 4/1992 Remington ..... 473/570
5,117,344 A * 5/1992 Perez ..... 362/352
5,236,383 A * 8/1993 Connelly ..... 446/219
6,012,826 A * 1/2000 Chabert ..... 362/363
7,073,917 B2 * 7/2006 VanderSchuit ..... 362/96
7,077,553 B2 * 7/2006 Vanderschuit ..... 362/565

* cited by examiner

*Primary Examiner*—Kien T Nguyen
(74) *Attorney, Agent, or Firm*—Bacon & Thomas, PLLC

(57) ABSTRACT

The present invention is to provide an inflatable bag comprising an airtight container, a cavity and a light-emitting unit. The cavity is formed at a top of the container. The cavity comprises a top opening flush with the top of the container, the opening being in communication with the container and the external. The light-emitting unit is mounted in the cavity by inserting through the opening. The light-emitting unit comprises a battery, a light-emitting member provided at a bottom in the cavity distal the opening, and a switch provided at a top projecting from the cavity. The battery is not electrically connected to the light-emitting member after inflating the container to a predetermined shape. The bag is adapted to emit light only by pressing the switch projected from the container to electrically connect the battery to the light-emitting member.

2 Claims, 4 Drawing Sheets

INFLATABLE BAG FOR EMITTING LIGHT

FIELD OF THE INVENTION

The present invention relates to inflatable bags and more particularly to such an inflatable bag having a light-emitting unit provided on its surface for facilitating switch pressing and cell replacement and having other advantages.

BACKGROUND OF THE INVENTION

A conventional inflatable bag (or balloon) is produced by molding two plastic films and sealing edges of the films. The produced inflatable bag is hollow, airtight. Typically, techniques of filling air or gas lighter than air into an inflatable bag comprise a manual filling and an automatic filling. For manual filling, there is at least one valve formed on an inflatable bag such that a user may fill air or gas lighter than air (e.g., helium) into the bag through the valve(s) to inflate same to a predetermined shape. For automatic filling, there is no valve formed on an inflatable bag. Instead, a chemical agent pouch and chemical powder are contained in the bag in advance. A user may break the chemical agent pouch by kneading. Liquid chemical agent contained in the chemical agent pouch then leaks to react with the chemical powder. As such, gas lighter than air is generated by the reaction. As an end, the bag is automatically inflated to a predetermined shape.

The prior art inflatable bag is served as tool for decoration, entertainment, or promotion irrespective of its air or gas filling technique being manual or automatic filling. Thus, it is typical of either printing or adhering specific patterns and characters on a surface of an inflatable bag or forming an inflatable bag having a specially designed shape for attracting people as its desired purpose. However, a typical inflatable bag has no special functions other than above. Further, such inflatable bags are typically used in a daylight or good vision environment. Otherwise (i.e., in a dark or poor vision environment), neither specific patterns and characters printed or adhered on a surface of an inflatable bag nor an inflatable bag having a specially designed shape can be clearly seen by people. As a result, its purpose of attracting people is compromised.

A type of inflatable bag capable of emitting light in a dark or poor vision environment for enabling people to see clearly specific patterns and characters printed or adhered on a surface or a specially designed shape thereof is produced by some manufacturers of the art. As a result, the purpose of an inflatable bag as tool for decoration, entertainment, or promotion is substantially achieved. Moreover, such inflatable bag may be used as a beacon in case of emergency. A typical inflatable bag 10 for emitting light is shown in FIG. 1. The inflatable bag 10 is formed of plastics and is a hollow, airtight bag. The bag 10 comprises at least one internal light-emitting module 20 including a mount 21, at least one cell 22 provided in the mount 21, and a light-emitting member (e.g., electric bulb or LED (light-emitting diode)) 23 provided in the mount 21; and a plastic strip 30 having one end attached to one side of the light-emitting module 20, and the other end affixed to an inner surface of its top 11 by heating. The cell 22 is electrically connected to the light-emitting member 23 when a user fills air (or gas lighter than air) into the bag 10. The light-emitting module 20 is supported by the strip 30 and is suspended in a center of the bag 10 when the bag 10 has inflated to a predetermined shape. Further, the light-emitting member 23 may emit light.

The inflatable bag 10 is formed of transparent plastics. Also, either specific patterns or characters are printed or adhered on a surface of an inflatable bag 10 by printing or adhering. Further, the patterns 40 (or characters) are formed on transparent portions of the bag 10. Other portions thereof are formed as opaque by printing or adhering. After inflating the bag 10 to a predetermined shape, light emitted by the light-emitting member 23 may pass the transparent portions. As a result, the specific patterns 40 or characters printed or adhered on the bag 10 can be clearly seen even in a dark or poor vision environment for attracting people.

In addition, one or more inflatable bags 10 are mounted in a venue to be held later. An on/off switch 25 provided on the mount 21 is pressed to an on position for electrically connecting the cell 22 to the light-emitting member 23 prior to air (or gas lighter than air) filling. As an end, the cell 22 continuously supplies electric current to the light-emitting member 23 for emitting light.

However, the inflatable bag 10 may be not capable of emitting light when a gathering is being held due to the consumed cell 22. Thus, it is required to replace consumed cell 22 with a new one. However, it is impossible of replacing the cell 22 at this time since the light-emitting module 20 is mounted within the inflatable bag 10. Alternatively, after inflating the inflatable bag 10, the cell 22 is electrically connected to the light-emitting member 23. Also, the light-emitting module 20 is supported by the strip 30 and is suspended in a center of the bag 10. Thus, it is impossible of pressing the switch 25 to supply electric current to the light-emitting member 23. In view of above, it is found that it is very inconvenient and troublesome to use the inflatable bag 10. Thus, it is desirable to inhibit the cell 22 from electrically connecting to the light-emitting member 23 after inflating the inflatable bag 10. Further, it is desirable to electrically connect the cell 22 to the light-emitting member 23 if necessary and the cell 22 can be replaced immediately if such case is arisen. Furthermore, it is desirable to press the switch 25 after inflating the inflatable bag 10 to a predetermined shape.

SUMMARY OF THE INVENTION

After considerable research and experimentation, an inflatable bag for emitting light according to the present invention has been devised so as to overcome the above drawbacks of the prior art.

It is an object of the present invention to provide an inflatable bag comprising an airtight container, a cavity and a light-emitting unit. The cavity is formed at a top of the container. The cavity comprises a top opening flush with the top of the container, the opening being in communication with the container and the external. The light-emitting unit is mounted in the cavity by inserting through the opening. The light-emitting unit comprises a battery, a light-emitting member provided at a bottom in the cavity distal the opening, and a switch provided at a top projecting from the cavity. The battery is not electrically connected to the light-emitting member after inflating the container to a predetermined shape. The bag is adapted to emit light only by pressing the switch projected from the container to electrically connect the battery to the light-emitting member.

In one aspect of the present invention the light-emitting unit further comprises a sleeve and a cap releasably secured to the sleeve. The sleeve is concealed by the cavity. The cap is projected from the opening. The battery is received in the sleeve with the light-emitting member being provided at an underside of the sleeve distal the opening. The switch is provided above the cap proximate the opening. Thus, it is possible of replacing a consumed battery in the sleeve by disengaging the cap with the sleeve.

The above and other objects, features and advantages of the present invention will become apparent from the following detailed description taken with the accompanying drawings.

DETAILED DESCRIPTION OF THE PREFERRED EMBODIMENTS

Figure 1:
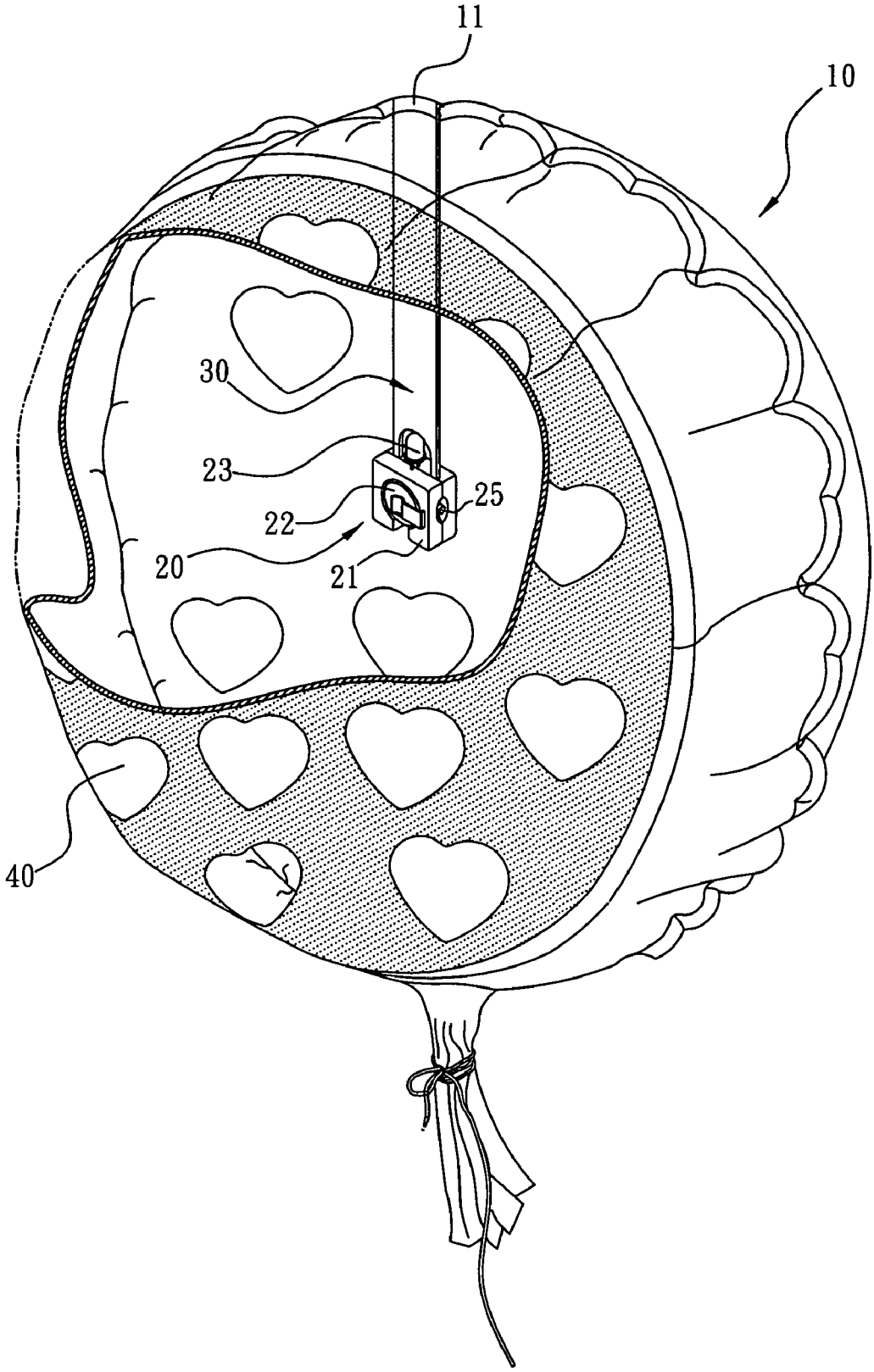
FIG. 1(Prior Art)
FIG. 1 is a partially broken away view of a conventional inflatable bag for emitting light.
Figure 2:
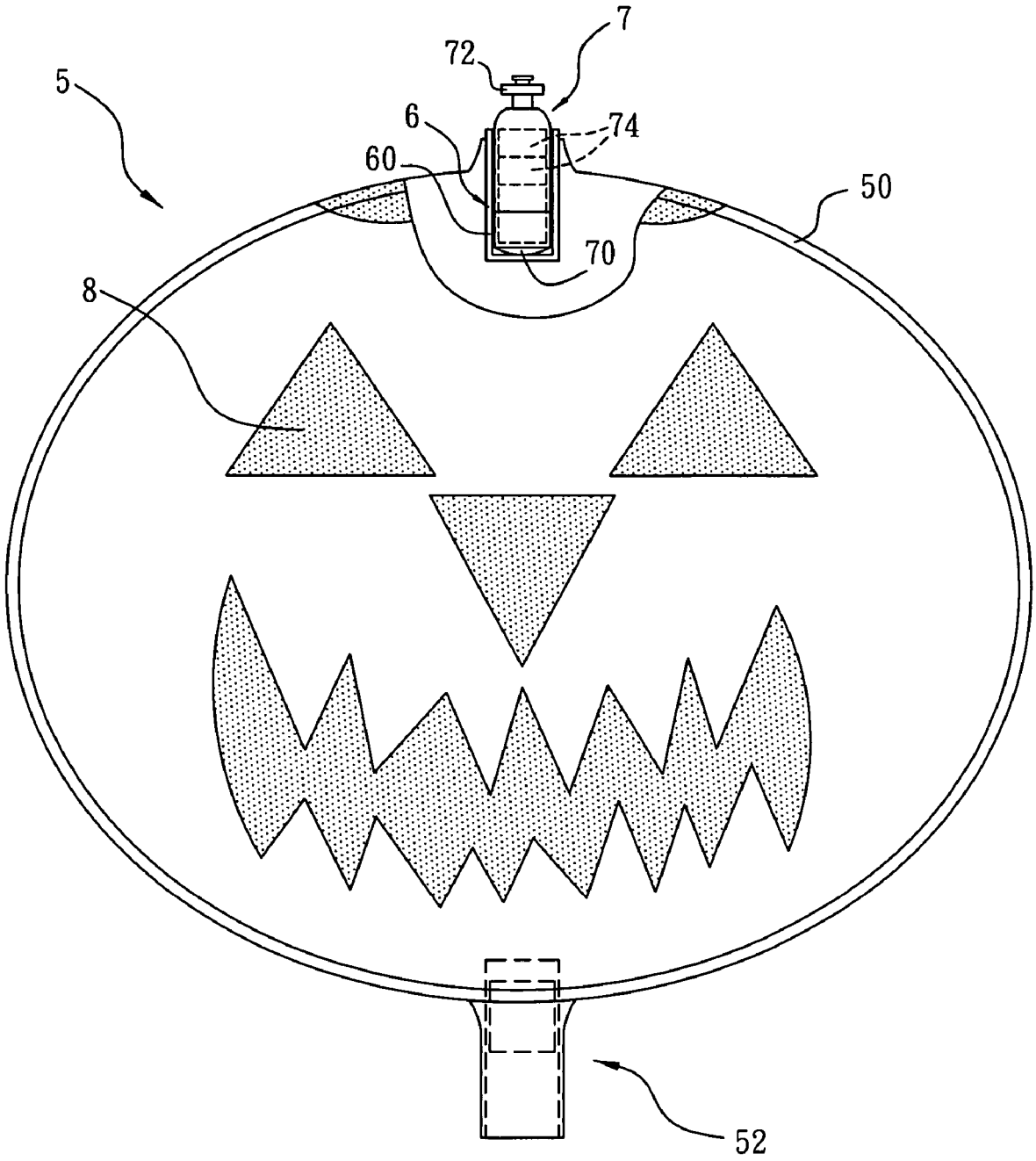
FIG. 2 is a perspective view of a first preferred embodiment of inflatable bag according to the invention prior to inflation.
Figure 3:
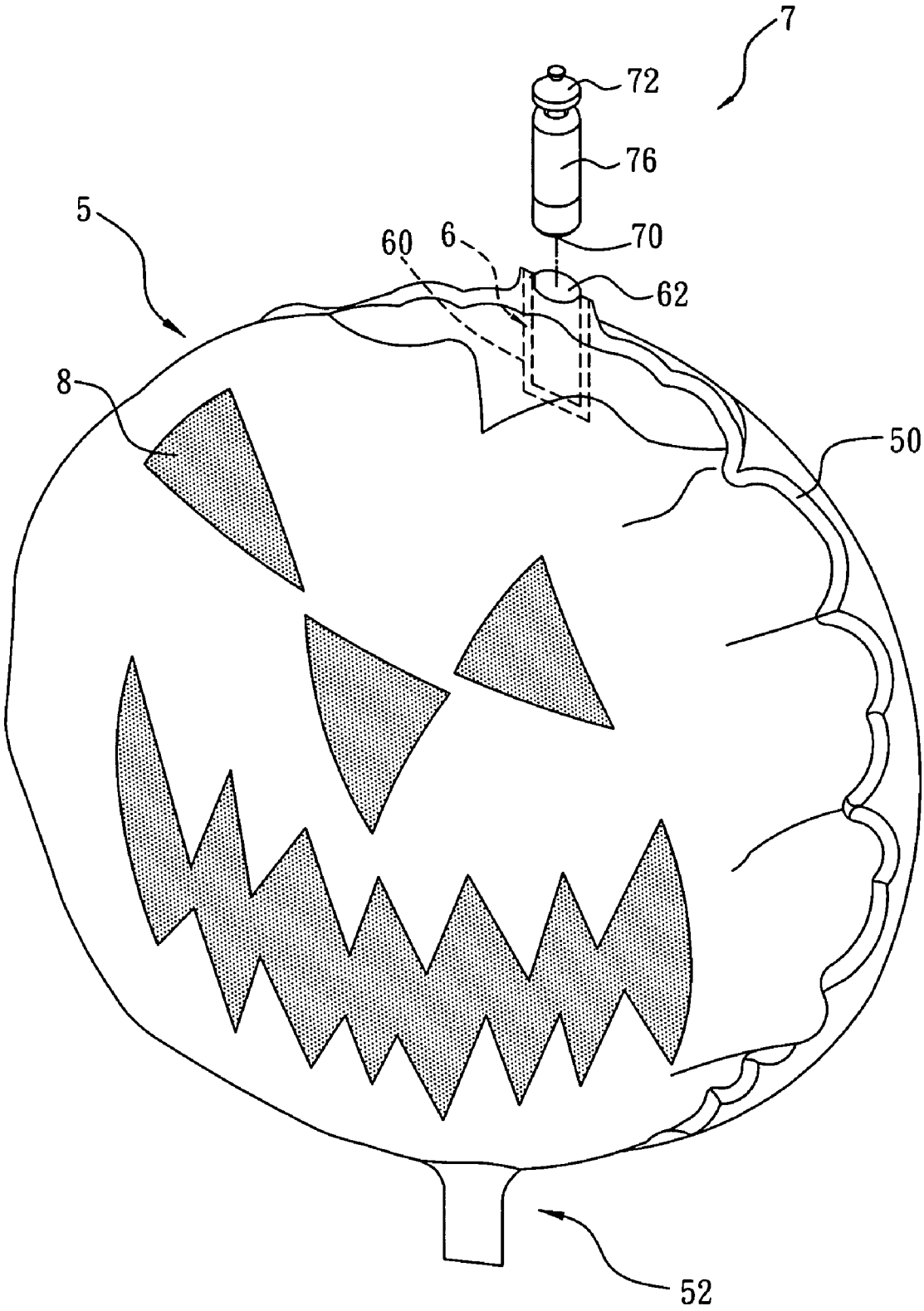
FIG. 3 is a view similar to FIG. 2 after inflation.

Referring to FIGS. 2 and 3, an inflatable bag for emitting light in accordance with a first preferred embodiment of the invention comprises an airtight inflatable container 5, a cylindrical cavity 6 formed at a raised top of the inflatable container 5, the cavity 6 including a top opening 62 flush with the top of the inflatable container 5, the opening 62 being in communication with the inflatable container 5 and the external, and a light-emitting unit 7 mounted in the cavity 6.

The light-emitting unit 7 comprises at least one light-emitting member 70 at a bottom distal the opening 62. Top of the light-emitting unit 7 is projected from the opening 62 and a switch 72 is formed at the top of the light-emitting unit 7. The light-emitting unit 7 further comprises a plurality of electrically connected cells 74. It is possible of operating (i.e., pressing) the switch 72 to inhibit the cells 74 from electrically connecting to the light-emitting member 70 after inflating the inflatable bag to a predetermined shape. Also, the switch 72 is projected from the cavity 6. By configuring as above, a user may operate the switch 72 to electrically connect the cells 74 to the light-emitting member 70, resulting in a lighting of the light-emitting member 70. Thus, it is desirable to mount one or more inflated inflatable bags in a venue to be held later. Next, a user may operate the switch 72 to electrically connect the cells 74 to the light-emitting member 70 to emit light just prior to the beginning of the gathering, resulting in an elimination of drawbacks of the prior art inflatable bag.

In the invention the container 5 comprises a peripheral first sealing member 50 on its inner surface. The cavity 6 comprises a peripheral second sealing member 60 on its inner surface adjacent the opening 62. A surface of the cavity 6 is sealed by the first sealing member 50 at a position adjacent the opening 62. As an end, an airtight, hollow bag is formed by both the container 5 and the cavity 6 with the opening 62 being in communication with the container 5 and the external.

In the invention the cavity 6 is molded in a manufacturing process the same as prior art inflatable bag. In detail, the manufacturing process involves heating most portions of peripheries of two plastic films for sealing (i.e., airtight) with a portion being not heated formed as an opening 62.

The container 5 and the cavity 6 are formed together in a manufacturing process the same as prior art inflatable bag. In detail, another two plastic films are placed in another mold. The cavity 6 is placed in peripheries of the films. The opening 62 is projected from the peripheries of the films. Next, the peripheries of the films are subjected to heating for sealing the peripheries of the films. Portions of the films facing the cavity 6 are formed as surface of the cavity 6. As an end, a hollow, airtight container 5 is formed.

Techniques of filling air or gas lighter than air into the container 5 comprise a manual filling and an automatic filling. For manual filling, there is at least one valve 52 formed on a bottom of the container 5 as shown in FIG. 2. A user may fill air or gas lighter than air (e.g., helium) into the container 5 through the valve 52 to inflate same to a predetermined shape. For automatic filling, there is no valve formed on the container 5. Instead, a chemical agent pouch (not shown) and chemical powder (not shown) are contained in the container 5 in advance. A user may break the chemical agent pouch by kneading. Liquid chemical materials contained in the chemical agent pouch then leak to react with the chemical powder. As such, gas lighter than air is generated. As an end, the container 5 is automatically inflated to a predetermined shape.

Referring to FIG. 2 again, either specific patterns 8 (or characters) are formed on a surface of a container 5 by printing or adhering. Further, the patterns 8 (or characters) are formed on transparent portions of the container 5. Other portions of the container 5 are formed as opaque by printing or adhering. Alternatively, in the other embodiments the patterns 8 (or characters) are formed on opaque portions of the container 5. Other portions of the container 5 are formed as transparent by printing or adhering. After inflating the container 5 to a predetermined shape, light emitted by the light-emitting member 70 may pass the transparent portions. As a result, the specific patterns 80 (or characters) printed or adhered on the inflatable container 5 can be clearly seen even in a dark or poor vision environment for attracting people.

Referring to FIGS. 2 and 3 again, in the first embodiment of the invention the light-emitting unit 7 further comprises a cylindrical tube 76 having a portion concealed by the cavity 6 and the remaining portion projecting from the opening 62. The light-emitting member 70 is provided at an underside of the tube 76 within the cavity 6. The switch 72 is provided above the tube 76 projecting from the opening 62. The cells 74 are received in the tube 76.

Figure 4:
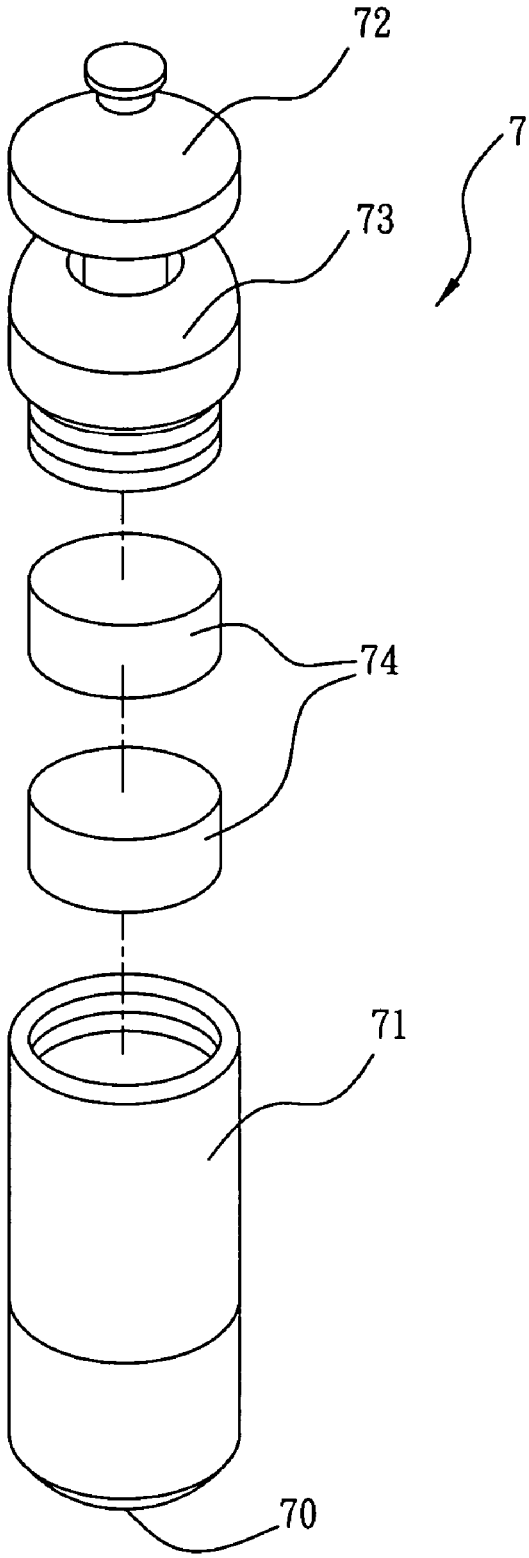
FIG. 4 is an exploded view of a second preferred embodiment of light-emitting unit according to the invention.

Referring to FIG. 4, in a second embodiment of the invention the light-emitting unit 7 comprises a cylindrical sleeve 71 having internal threads, and a cap 73 having an externally threaded extension. A plurality of electrically connected cells 74 are received in the sleeve 71. The cap 73 is threadedly secured to the sleeve 71 for fastening the cells 74 in the sleeve 71. The sleeve 71 is concealed by the cavity 6. The cap 73 is projected from the opening 62. The light-emitting member 70 is provided at an underside of the sleeve 71 distal the opening 62. The switch 72 is provided above the cap 73 proximate the opening 62. It is thus possible of replacing a consumed cell 74 in the sleeve 71 by disengaging the cap 73 with the sleeve 71.

In view of above, it is understood that an inflatable bag for emitting light of the invention is capable of emitting light in a dark or poor vision environment for enabling people to see clearly specific patterns and characters printed or adhered thereon. As such, purpose as tool for decoration, entertainment, or promotion is substantially achieved. Moreover, an inflatable bag for emitting light of the invention can be positioned by attaching to a rope. Next, inflate helium into the bag. The bag then is able to float in the dark air by quickly rising above vision obstacles (e.g., bushes, hills, or valleys). Specific patterns and characters for help written or formed on a surface of the bag are thus clearly seen by light emitted by the light-emitting unit 7. In other words, the bag can be used as a beacon for quickly informing other people to save them in case of emergency. Moreover, the cells 74 are inhibited from electrically connecting to the light-emitting member 70 after inflating the inflatable bag. Further, the switch 72 is projected from the inflatable bag such that it is possible of pressing the switch 72 to electrically connect the cells 74 to the light-emitting member 70 after inflating the inflatable bag. Furthermore, the cap 73 and the sleeve 71 are threadedly secured together. It is thus possible of replacing a consumed cell 74 by disengaging the cap 73 with the sleeve 71. In brief, all drawbacks of the prior art inflatable bag for emitting light are eliminated by the invention.

While the invention herein disclosed has been described by means of specific embodiments, numerous modifications and variations could be made thereto by those skilled in the art without departing from the scope and spirit of the invention set forth in the claims.

What is claimed is:

1. An inflatable bag comprising:

an airtight container;

a cavity formed at a top of the container, the cavity including a top opening flush with the top of the container, the opening being in communication with the container and the external; and a light-emitting unit mounted in the cavity by inserting through the opening, the light-emitting unit including a battery, a light-emitting member provided at a bottom in the cavity distal the opening, and a switch provided at a top projecting from the cavity;

wherein the switch is adapted to press to electrically connect the battery to the light-emitting member for emitting light or not;

wherein the container includes a peripheral first sealing member on its inner surface, the cavity further includes a peripheral second sealing member on its inner surface adjacent the opening, a surface of the cavity is sealed by the first sealing member at a position adjacent the opening;

wherein an airtight, hollow bag is formed by both the container and the cavity with the opening being in communication with the container and the external; and wherein the light-emitting unit further includes a tube having one portion concealed by the cavity and the other portion projecting from the opening, the light-emitting member is provided at an underside of the tube within the cavity, the switch is provided above the tube projecting from the opening, and the battery is received in the tube.

2. An inflatable bag comprising:

an airtight container;

a cavity formed at a top of the container, the cavity including a top opening flush with the top of the container, the opening being in communication with the container and the external; and a light-emitting unit mounted in the cavity by inserting through the opening, the light-emitting unit including a battery, a light-emitting member provided at a bottom in the cavity distal the opening, and a switch provided at a top projecting from the cavity;

wherein the switch is adapted to press to electrically connect the battery to the light-emitting member for emitting light or not;

wherein the container includes a peripheral first sealing member on its inner surface, the cavity further includes a peripheral second sealing member on its inner surface adjacent the opening, a surface of the cavity is sealed by the first sealing member at a position adjacent the opening;

wherein an airtight, hollow bag is formed by both the container and the cavity with the opening being in communication with the container and the external; and wherein the light-emitting unit further includes a sleeve concealed by the cavity, the sleeve adapted to receive the battery with the light-emitting member being provided at an underside of the sleeve distal the opening; and a cap releasably secured to the sleeve and projected from the opening with the switch being provided above the cap proximate the opening.

* * * * *